US009058044B2

(12) United States Patent
Smith et al.

(10) Patent No.: US 9,058,044 B2
(45) Date of Patent: Jun. 16, 2015

(54) REFERENCE VOLTAGE GENERATION CIRCUIT

(71) Applicant: MStar Semiconductor, Inc., Hsinchu Hsien (TW)

(72) Inventors: Sterling Smith, Hsinchu County (TW); Ying-Jia Zhu, Hsinchu County (TW); Jian-Ping Cheng, Hsinchu County (TW)

(73) Assignee: MSTAR SEMICONDUCTOR, INC., Hsinchu Hsien (TW)

( * ) Notice: Subject to any disclaimer, the term of this patent is extended or adjusted under 35 U.S.C. 154(b) by 213 days.

(21) Appl. No.: 13/951,565

(22) Filed: Jul. 26, 2013

(65) Prior Publication Data

US 2014/0029769 A1 Jan. 30, 2014

(30) Foreign Application Priority Data

Jul. 27, 2012 (CN) ..... 2012 2 0370145 U

(51) Int. Cl.
*G05F 1/10* (2006.01)
*G05F 1/575* (2006.01)

(52) U.S. Cl.
CPC . *G05F 1/10* (2013.01); *G05F 1/575* (2013.01)

(58) Field of Classification Search
None
See application file for complete search history.

(56) References Cited

U.S. PATENT DOCUMENTS

2005/0151589 A1* 7/2005 Fallesen ..... 330/259
2012/0155675 A1* 6/2012 Froehlich et al. ..... 381/120

* cited by examiner

*Primary Examiner* — Paul Huber
(74) *Attorney, Agent, or Firm* — WPAT, PC; Justin King

(57) ABSTRACT

A reference voltage generation circuit includes an auto-activation unit, an operational amplifier unit, and a tail current resistor. An input of the operational amplifier is grounded via the tail current resistor. The auto-activation unit is coupled to the operational amplifier so that the circuit operates at an operating point. A reduction of current noises, circuit area, and overall cost occurs implemented through the described tail current unit

9 Claims, 7 Drawing Sheets

REFERENCE VOLTAGE GENERATION CIRCUIT

REFERENCE VOLTAGE GENERATION CIRCUIT

This application claims the benefit of People's Republic of China application Serial No. 201220370145.7, filed Jul. 27, 2012, the subject matter of which is incorporated herein by reference.

BACKGROUND OF THE INVENTION

1. Field of the Invention

The invention relates in general to a bias circuit, and more particularly to a reference voltage generation circuit.

2. Description of the Related Art

FIG. 1 shows a reference voltage generation circuit as known in the prior art. As shown in FIG. 1, a conventional reference voltage generation circuit 10 comprises an operational amplifier 101 and resistors 102 and 103. An inverting input end of the operational amplifier 101 is connected between the resistors 102 and 103. The resistor 102 has one end grounded and the other end connected to one end of the resistor 103, which has the other end connected to an output end of the operational amplifier 101. The circuit 10 is applied in a microphone bias circuit (MICBIAS) that demands an extremely low output noise (e.g., smaller than 3 μm), an output voltage between 1.9V and 2.3V, a great current (e.g., greater than 3 mA), and a voltage-temperature change of smaller than 5%. In the prior art, the circuit 10 inputs a low-noise reference voltage Vref at a non-inverting end of the operational amplifier 101 to achieve the above requirements of the MICBIAS. Preferably, a large-size capacitor for inputting the reference voltage Vref at the non-inverting end of the operational amplifier is disposed. At this point, the MICBIAS is in equivalence a buffer. However, due to a large volume of the large-size capacitor, a large space in the MICBIAS is occupied while also increasing costs of the MICBIAS.

SUMMARY OF THE INVENTION

The invention is directed to a reference voltage generation circuit for reducing costs and outputting a stable reference voltage having a low noise and a low temperature coefficient.

According to an aspect of the present invention, a reference voltage generation circuit is provided. The reference voltage generation circuit comprises an auto-activation unit, an operational amplifier unit and a tail current resistor. An input end of the operational amplifier unit is grounded via the tail current resistor. The auto-activation unit is coupled to the operational amplifier unit so that the circuit operates at an operating point.

In the present invention, with the auto-activation unit, the operational amplifier unit and the tail current resistor, combined with the configurations of the input end of the operational amplifier unit grounded via the tail current resistor and the auto-activation unit coupled to the operational amplifier unit, the circuit is allowed to operate at an operating point. Further, current noises as well as a circuit area and costs are reduced by a tail current implemented through the described tail current unit.

The above and other aspects of the invention will become better understood with regard to the following detailed description of the preferred but non-limiting embodiments. The following description is made with reference to the accompanying drawings.

DETAILED DESCRIPTION OF THE INVENTION

Figure 1:
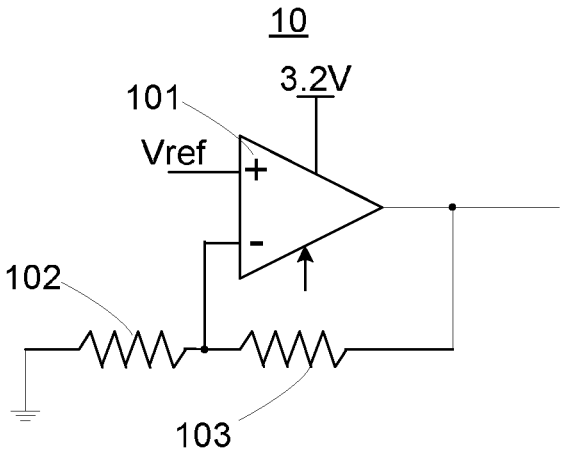
FIG. 1(prior art)
FIG. 1 is a schematic diagram of a reference voltage generation circuit known in the prior art.
Figure 2:
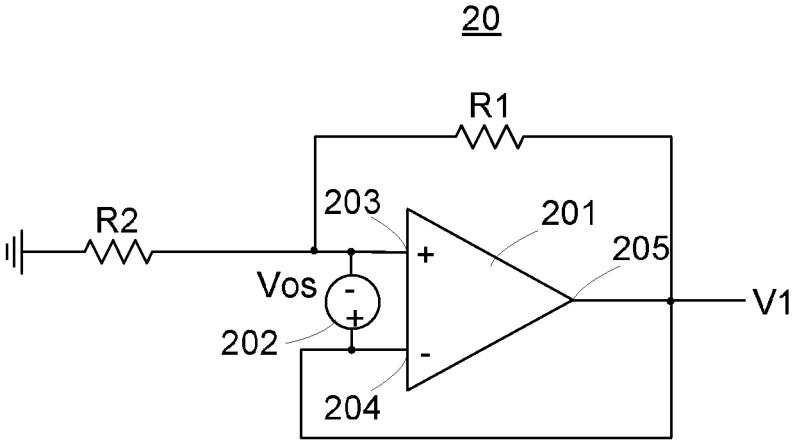
FIG. 2 is a schematic diagram of a reference voltage generation circuit according to a first embodiment of the present invention.

FIG. 2 shows a schematic diagram of a reference voltage generation circuit according to a first embodiment of the present invention. As shown in FIG. 2, a reference voltage generation circuit 20 disclosed by the embodiment comprises an operational amplifier 201, a voltage source 202, a resistor R1, and a resistor R2. Preferably, the voltage source 202 is a constant current source.

In the embodiment, the operational amplifier 201 has an inverting input end 203 connected to a negative end of the voltage source 202, and a non-inverting input end 204 connected to a positive end of the voltage source 202. The resistor R2 has one end connected to the inverting end 203 of the operational amplifier 201, and the other end grounded. The resistor R1 has one end connected to the inverting input end 203 of the operational amplifier 201, and the other end connected to an output end of the operational amplifier 201. The inverting input end 204 of the operational amplifier 201 is also connected to the output end 205 of the operational amplifier 201. The non-inverting input end 203 of the operational amplifier 201, the resistor R1, the resistor R2, and the output end 205 of the operational amplifier 201 form a positive feedback loop. The inverting input end 204 of the operational amplifier 201 and the output end 205 of the operational amplifier 201 form a negative feedback loop. When a gain of the negative feedback loop is greater than a gain of the positive feedback loop, the reference voltage generation circuit 20 disclosed by the embodiment is capable of generating a stable reference voltage V1.

Operation principles of the reference voltage generation circuit 20 of the embodiment are described in detail below.

In the embodiment, by disposing the voltage source 202 at the inverting input end 204 and the non-inverting input end 203 of the operational amplifier 201, a voltage difference occurs between the inverting input end 204 and the non-inverting input end 203 of the operational amplifier 201 to generate the reference voltage V1. The voltage of the voltage source is Vos, i.e., the voltage difference between the inverting input end 204 and the non-inverting input end 203 of the operational amplifier 201 is Vos. When the operational amplifier 201 is substantially equal to an infinite resistor, the reference voltage outputted by the circuit 20 is V1=(R1+R2)/R*Vos. Thus, by adjusting a ratio of the resistor R1 to the resistor R2, the circuit 20 outputs the reference voltage V1 satisfying a user requirement. Further, as the gain of the negative loop is greater than the gain of the positive loop, the circuit 20 is capable of providing a stable output.

Different from the prior art, the voltage source 202 is disposed at the inverting input end 204 and the non-inverting input end 203 of the operational amplifier 201, so that the stable reference voltage V1 can be output without involving a large-size capacitor and thus reducing costs.

Figure 3:
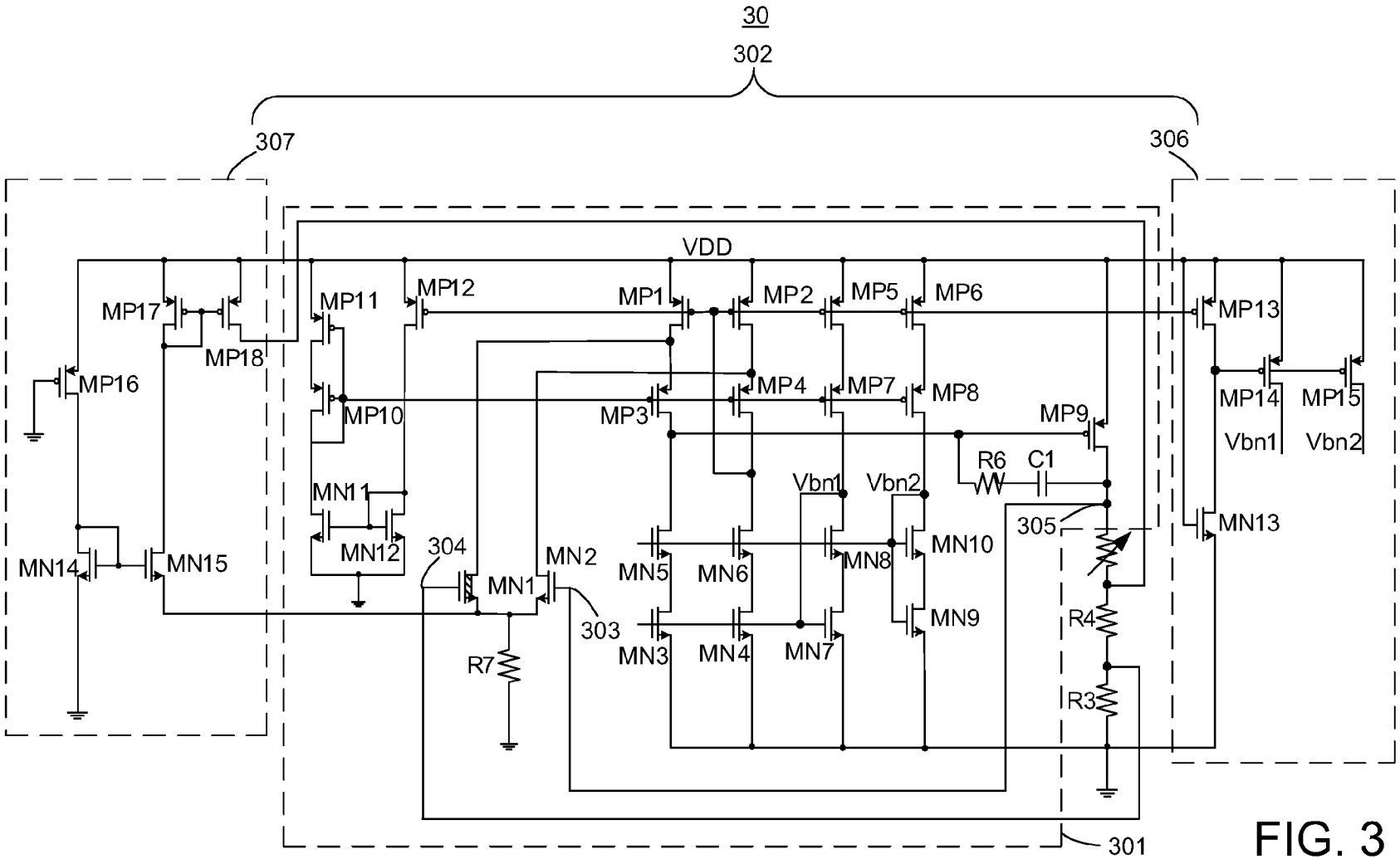
FIG. 3 is a schematic diagram of a reference voltage generation circuit according to a second embodiment of the present invention.

FIG. 3 shows a schematic diagram of a reference voltage generation circuit according to a second embodiment of the present invention. As shown in FIG. 3, a reference voltage generation circuit 30 disclosed by the embodiment comprises an operational amplifier unit 301, a tail current resistor R7, an auto-activation unit 302, a first resistor R3, a second resistor R4, and a third resistor R5. It is noted R5 is an adjustable/variable resistor.

In the embodiment, an inverting input end 303 of the operational amplifier unit 301 is connected to an output end 305 of the operational amplifier unit 303 to form a negative feedback loop. The first resistor R3 has one end connected to a non-inverting input end 304 of the operational amplifier unit 301, and the other end grounded. The second resistor R4 has one end connected to one end of the first resistor R3, and the other end connected to one end of the third resistor R5. The third resistor R3 has the other end connected to the output end 305 of the operational amplifier unit 301. The non-inverting input end 304 of the operational amplifier unit 301, the first resistor R3, the second resistor R4, the third resistor R5, and the output end 305 of the operational amplifier unit 301 form a positive feedback loop. In the embodiment, when the gain of the negative feedback loop is greater than the gain of the positive feedback loop, the circuit 30 generates a reference voltage Vref at the output end 305 of the operational amplifier unit 301.

In the embodiment, the operational amplifier unit 301 comprises a stage-one mirror compensation unit and a stage-two mirror compensation unit. The first-stage mirror compensation unit comprises a P-type MOS transistor MP1, a P-type MOS transistor MP2, a P-type MOS transistor MP3, a P-type MOS transistor MP4, an N-type MOS transistor MN3, an N-type MOS transistor MN4, an N-type MOS transistor MN5, and an N-type MOS transistor MN6. The second-stage mirror compensation unit comprises a P-type MOS transistor MP5, a P-type MOS transistor MP6, a P-type MOS transistor MP7, a P-type MOS transistor MP8, an N-type MOS transistor MN7, an N-type MOS transistor MN8, an N-type MOS transistor MN9, and an N-type MOS transistor MN10. The operational amplifier unit 301 further comprises an N-type MOS transistor MN1, an N-type MOS transistor MN2, an N-type MOS transistor MN11, an N-type MOS transistor MN12, a P-type MOS transistor MP9, a P-type MOS transistor MP10, a P-type MOS transistor MP11, a P-type MOS transistor MP12, a resistor R6, and a capacitor C1.

In the embodiment, the first-stage mirror compensation unit and the second-stage mirror compensation unit are connected in parallel between the non-inverting input end 304 of the operational amplifier unit 301, the inverting input end 303 of the operational amplifier unit 301 and the output end 305 of the operational amplifier unit 301. The gate of the N-type MOS transistor MN1 is the non-inverting input end 304 of the operational amplifier unit 301, the gate of the N-type MOS transistor MN2 is the inverting input end 303 of the operational amplifier unit 301, and the drain of the P-type MOS transistor MP9 is the output end 305 of the operational amplifier unit 301.

In the embodiment, the source of the P-type MOS transistor MP1, the source of the P-type MOS transistor MP2, the source of the P-type MOS transistor MP5, the source of the P-type MOS transistor MP6, the source of the P-type MOS transistor MP9, the source of the P-type MOS transistor MP11, and the source of the P-type MOS transistor MP12 are all connected to a first reference voltage VDD. The gate of the P-type MOS transistor MP1 is connected to the gate of the P-type MOS transistor MP2, the gate of the P-type MOS transistor MP5, the P-type MOS transistor MP6, and the gate of the P-type MOS transistor MP12. The drain of the P-type MOS transistor MP1 is connected to the source of the P-type MOS transistor MP3. The gate of the P-type MOS transistor MP3 is connected to the gate of the P-type MOS transistor MP4, the gate of the P-type MOS transistor MP7, the gate of the P-type MOS transistor MP8, the gate of the P-type MOS transistor MP10, and the gate of the P-type MOS transistor MP11. The drain of the P-type MOS transistor MP3 is connected to the drain of the N-type MOS transistor MN5. The gate of the N-type MOS transistor MN5 is connected to the gate of the N-type MOS transistor MN6, the gate of the N-type MOS transistor MN8, the gate of the N-type MOS transistor MN9, and the gate of the N-type MOS transistor MN10. The source of the N-type MOS transistor MN5 is connected to the drain of the N-type MOS transistor MN3. The gate of the N-type MOS transistor MN3 is connected to the gate of the N-type MOS transistor MN4 and the gate of the N-type MOS transistor MN7. The source of the N-type MOS transistor MN3, the source of the N-type MOS transistor MN4, the source of the N-type MOS transistor MN7, and the source of the N-type MOS transistor MN9 are all grounded. The drain of the P-type MOS transistor MP2 is connected to the source of the P-type MOS transistor MP4. The drain of the P-type MOS transistor MP4 is connected to the drain of the N-type MOS transistor MN6. The drain of the P-type MOS transistor MP4 is connected to the gate of the P-type MOS transistor MP1. The source of the N-type MOS transistor MN6 is connected to the drain of the N-type MOS transistor MN4. The drain of the P-type MOS transistor MP5 is connected to the source of the P-type MOS transistor MP7. The drain of the P-type MOS transistor MP7 is connected to the drain of the N-type MOS transistor MN8. The drain of the N-type MOS transistor MN8 is further connected to the gate of the N-type MOS transistor MN7. The source of the N-type MOS transistor MN8 is connected to the drain of the N-type MOS transistor MN7. The drain of the P-type MOS transistor MP6 is connected to the source of the P-type MOS transistor MP8. The drain of the P-type MOS transistor MP8 is connected to the drain of the N-type MOS transistor MN10. The drain of the N-type MOS transistor MN10 is further connected to the gate of the N-type MOS transistor MN10. The source of the N-type MOS transistor MN10 is connected to the drain of the N-type MOS transistor MN9. The gate of the P-type MOS transistor MP9 is connected to the drain of the P-type MOS transistor MP3. The drain of the P-type MOS transistor MP9 is connected to the other end of the third resistor R5. The resistor R6 has one end connected to the gate of the P-type MOS transistor MP9 and the other end connected to one end of the capacitor C1. The capacitor C1 has the other end connected to the drain of the P-type MOS transistor MP9. The drain of the P-type MOS transistor MP11 is connected to the source of the P-type MOS transistor MP10. The drain of the P-type MOS transistor MP10 is connected to the gate of the P-type MOS transistor MP10 and the drain of the N-type MOS transistor MN11. The gate of the N-type MOS transistor MN11 is connected to the gate of the N-type MOS transistor MN12 and the drain of the N-type MOS transistor MN12. The source of the N-type MOS transistor MN11 is connected to the source of the N-type MOS transistor MN12. The drain of the P-type MOS transistor MP12 is connected to the drain of the N-type MOS transistor MN12. The drain of the N-type MOS transistor MN1 is connected to the drain of the P-type MOS transistor MP1. The gate of the N-type MOS transistor MN1 is connected between the first resistor R3 and the second resistor R4. The source of the N-type MOS transistor MN1 is connected to one end of the tail current resistor R7, which has the other end grounded. The drain of the N-type MOS transistor MN2 is connected to the drain of the P-type MOS transistor MP2. The gate of the N-type MOS transistor MN2 is connected to the drain of the P-type MOS transistor MP9. The source of the N-type MOS transistor MN2 is connected to one end of the tail current resistor R7.

In the embodiment, the third resistor R5 is preferably an adjustable resistor, the N-type MOS transistor MN1 is preferably a native device (e.g., a depletion type MOS transistor), and the N-type MOS transistor MN2 is preferably an IO device (e.g., an enhancement type MOS transistor). The N-type MOS transistor MN1 has a threshold voltage of smaller than zero, and the N-type MOS transistor MN2 has a gate voltage of approximately 600 mV. Further, to reduce noises of the circuit 30, the tail current is implemented by the tail current resistor R7.

In the embodiment, relations of sizes of the main MOS transistors in the operational amplifier unit 301 are as follows:

$$MP1=MP2=N1*MP5=N1*MP6;$$

$$MP3=MP4=N2*MP7=N2*MP8;$$

$$MN5=MN6=N2*MN8=N2*MN10; \text{ and}$$

$$MN3=MN4=N2*MN7.$$

In the above equations, N1 and N2 are coefficients. Thus, relations of currents of the main MOS transistors in the operational amplifier unit 301 are as follows:

$$|(MP1)=|(MP2)=N1*|(MP5)=N1*|(MP6);$$

$$|(MN3)=|(MN4)=N2*|(MN7)=N2*|(MP5);$$

$$|(MN1)=|(MN2)=(N1-N2)*|(MP5); \text{ and}$$

$$|(MN2)=(Vout-Vgs)/(R7/2)=(Vout*R3/(R3+R4+R5)-Vgs1)/(R7/2).$$

In the above equations, Vgs1 is the voltage between the gate and the source of the N-type MOS transistor MN1, Vgs2 is the voltage between the gate and the drain of the N-type MOS transistor Mn2, R7 is a resistance value of the tail current resistor R7, R3 is a resistance value of the first resistor R3, R4 is a resistance value of the second resistor R4, and R5 is a resistance value of the third resistor R5.

Figure 4:
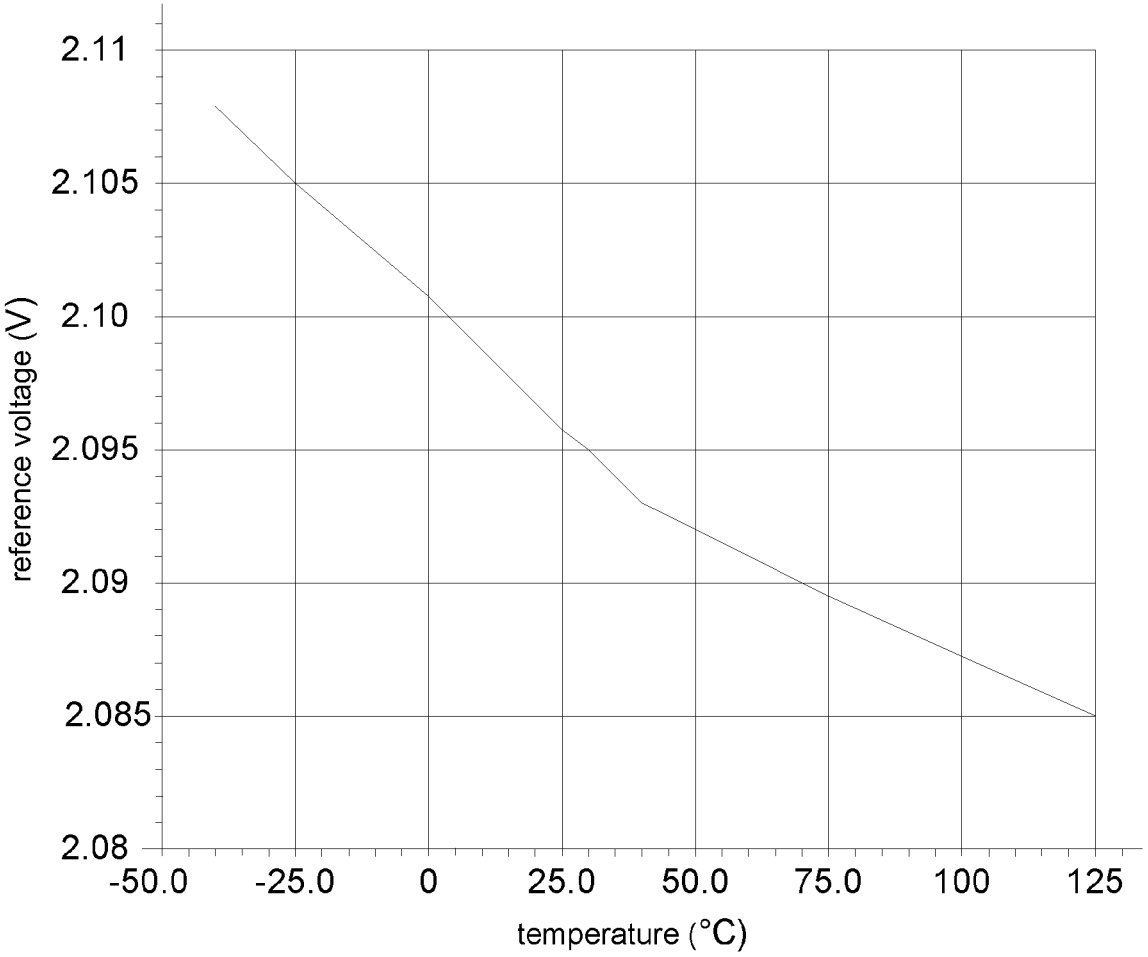
FIG. 4 is a relationship diagram of a reference voltage output by the circuit in FIG. 3 and the temperature.

FIG. 4 shows a relationship diagram of a reference voltage output by the circuit in FIG. 3 and the temperature. As shown in FIG. 4, by adjusting the sizes of the N-type MOS transistor MN1 and the N-type MOS transistor MN2, the circuit 30 is given a good temperature coefficient and is thus capable of outputting a stable reference voltage Vout.

In the embodiment, the operational amplifier unit 301 has three stable operating points. The first stable operating point is a normal operating point, the second stable operating point is when the output voltage is zero, and the third stable operating point is when the output voltage is significantly lower than the reference voltage Vout output at the normal operating point. When the operational amplifier unit 301 is at the first stable operating point, the circuit 30 outputs the stable reference voltage Vref. When the operational amplifier unit 301 is at the second stable operating point, the N-type MOS transistor MN1 and the N-type MOS transistor MN2 are disconnected such that no current flows through the tail current resistor R7. At this point, the P-type MOS transistors MP1 to MP8 and the N-type MOS transistors MN5 to MN10 are all disconnected, in a way that the P-type MOS transistor is turned off and no current flows through the resistors R3 to R5. Thus, the reference voltage Vout output by the circuit 30 is zero at this point. When the operational amplifier unit 301 operates at the third stable operating point, the voltage output by the circuit 30 is lower than Vout.

Figure 5:
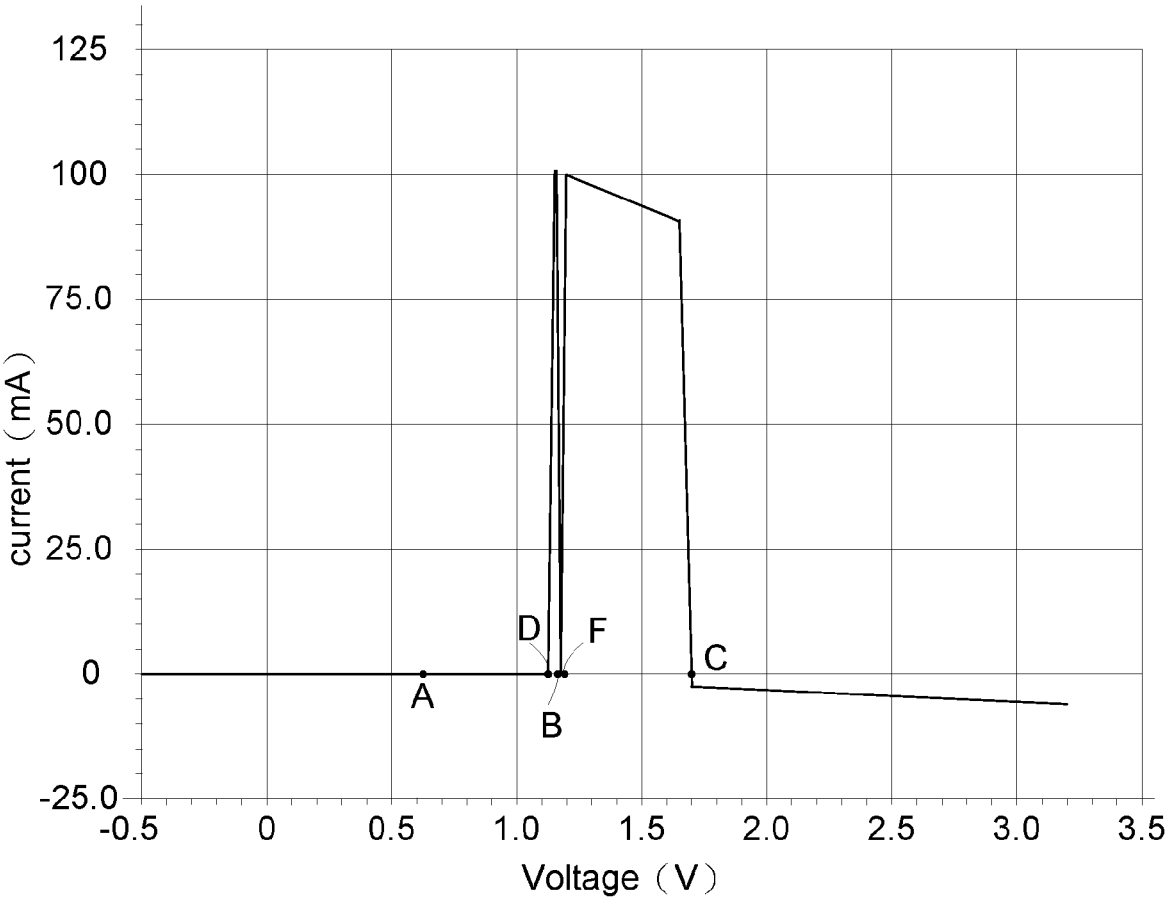
FIG. 5 is a relationship diagram of a current and a voltage of a voltage source disposed at an output end of the operational amplifier unit in FIG. 3.

In the embodiment, the three stable operating points of the operational amplifier unit 301 are described with the output end 305 of the operational amplifier unit 301 and a voltage source. A voltage range of the voltage source is selected as −0.5V to 3.2V, and a current passing through the voltage source is detected. FIG. 5 shows a relationship diagram of a current passing through the voltage source and a voltage of the voltage source. In FIG. 5, the horizontal axis represents the voltage value of the voltage source, and the vertical axis represents the current value of the voltage source. Further, the current passing through the voltage source is a 0 mA operating point; operating points from top downwards in the diagram are stable operating points, e.g., operating points A, B, and C; operating points from down upwards are unstable operating points, e.g., operating points D and F. When the current passing through the voltage source is positive, the voltage source receives the current, i.e., the output end 305 of the operational amplifier 301 releases an outbound current. At this point, the operating point moves towards the direction of an increasing voltage (i.e., moves towards the right side). When the current passing through the voltage source is negative, the voltage source releases an outbound current towards the output end 305 of the operational amplifier unit 301. At this point, the operating point moves towards a decreasing voltage (i.e., moves towards the left side).

Details of how the circuit 30 operates at a normal operating point by coupling the auto-activation unit 302 to the operational amplifier unit 303 are described below.

In the embodiment, the auto-activation unit 302 comprises a first auto-activation unit 306 and a second auto-activation unit 307. The first auto-activation unit 306 and the second auto-activation unit 307 are connected in parallel to the operational amplifier unit 301. The first auto-activation unit 306 comprises a first MOS transistor MP13, a second MOS transistor MN13, a third MOS transistor MP14, and a fourth MOS transistor MP15. The second auto-activation unit 307 comprises a fifth MOS transistor MP18, a sixth MOS transistor MP17, a seventh MOS transistor MP16, an eighth MOS transistor MN14, and a ninth MOS transistor MP15. Preferably, the first MOS transistor MP13, the third MOS transistor MP14, the fourth MOS transistor MP15, the fifth MOS transistor MP18, the sixth MOS transistor MP17, and the seventh MOS transistor MP16 are all P-type MOS transistors. Preferably, the second MOS transistor MN13, the eighth MOS transistor MN14, and the ninth MOS transistor MN15 are all N-type MOS transistors. That is, the first MOS transistor MP13 is a P-type MOS transistor MP13, the second MOS transistor MN13 is an N-type MOS transistor MN13, the third MOS transistor MP14 is a P-type MOS transistor MP14, the fourth MOS transistor MP15 is a P-type MOS transistor MP15, the fifth MOS transistor MP18 is a P-type MOS transistor MP18, the sixth MOS transistor MP17 is a P-type MOS transistor MP17, the seventh MOS transistor MP16 is a P-type MOS transistor MP16, the eighth MOS transistor MN14 is an N-type MOS transistor MN14, and the ninth MOS transistor MN15 is an N-type MOS transistor MN15.

Figure 6:
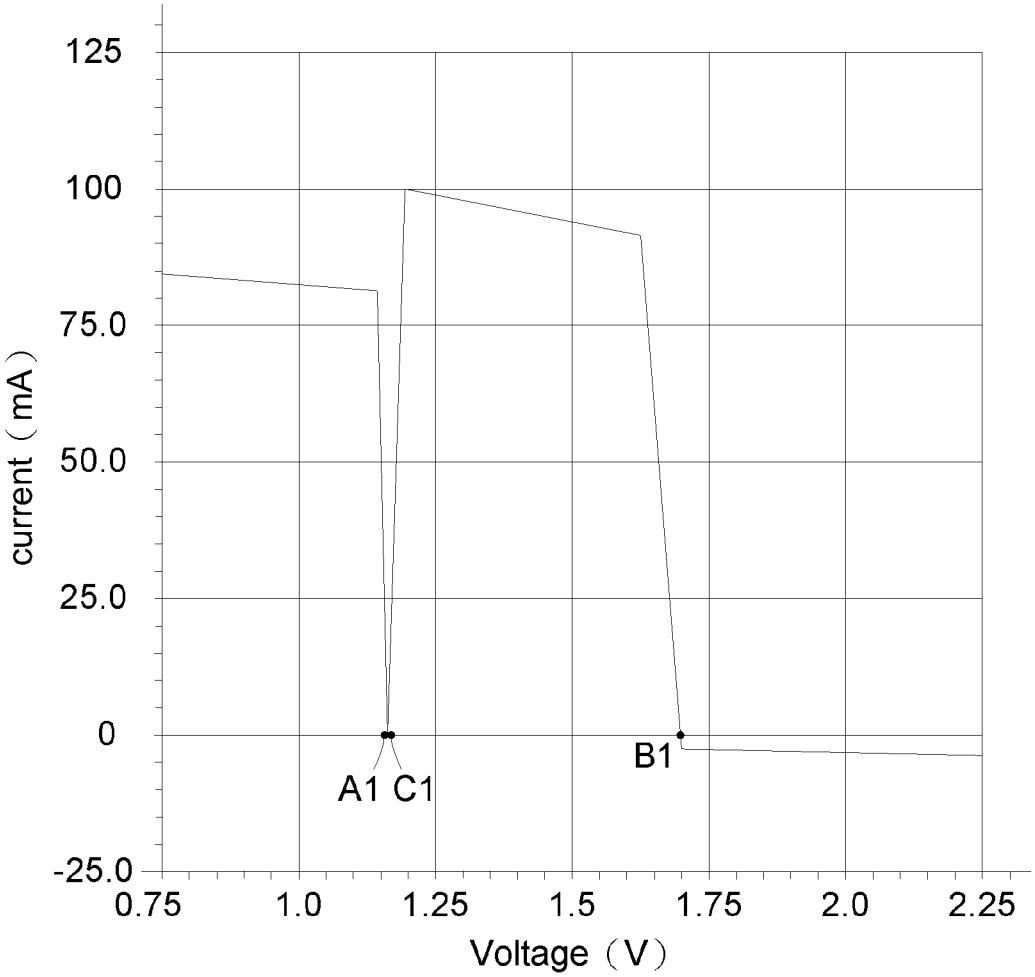
FIG. 6 is a relationship diagram of a current passing through a voltage source and a voltage of the voltage source after coupling the operational amplifier unit in FIG. 3 to a first auto-activation unit.

In the embodiment, the operational amplifier unit 301 is coupled to the first auto-activation unit 306. The source of the P-type MOS transistor MP13, the source of the P-type MOS transistor MP14 and the source of the P-type MOS transistor MP15 are connected to the first reference voltage VDD. The gate of the P-type MOS transistor MP13 is connected to the gate of the P-type MOS transistor MP1. The drain of the P-type MOS transistor MP13 is connected to the drain of the N-type MOS transistor MN13, the gate of the P-type MOS transistor MP14 and the gate of the P-type MOS transistor MP15. The gate of the N-type MOS transistor MN13 is connected to the first reference voltage VDD, and the source of the N-type MOS transistor MN13 is grounded. The drain of the P-type MOS transistor MP14 is connected to the drain of the N-type MOS transistor MN8 (via Vbn1), and the drain of the P-type MOS transistor MP15 is connected to the gate of the N-type MOS transistor MN10 (Vbn2). At this point, with the operational amplifier unit 301 in conjunction with the first auto-activation unit 306, the operational amplifier unit 301 is no longer operable at the second stable operating point. Operating principles of such are as follows. A voltage difference V2 exist between the inverting input end 303 and the non-inverting input end 304 of the operational amplifier unit 301, and the N-type MOS transistor MN13 is substantially equal to an extremely large resistor. When the gate voltage of the P-type MOS transistor MP1 and the gate voltage of the P-type MOS transistor MP2 are greater than the voltage difference between the first reference voltage VDD and V2, the P-type MOS transistor MP13 is turned off with no current passing through the P-type MOS transistor MP13, the gate voltage of the P-type MOS transistor MP14 and the gate voltage of the P-type MOS transistor MP15 are both zero, with the gate of the P-type MOS transistor MP14 and the P-type MOS transistor MP15 being conducted, in a way that a current respectively passes through the P-type MOS transistor MP14 and the P-type MOS transistor MP15 to enter Vbn1 and Vbn2, i.e., the current respectively enters the N-type MOS transistor MN8 and the N-type MOS transistor MN10. At this point, the N-type MOS transistors MN3 to MN6 are all conducted; the gate voltage of the P-type MOS transistor MP1, the gate voltage of the P-type MOS transistor MP2, the gate voltage of the P-type MOS transistor MP5, the gate voltage of the P-type MOS transistor MP6, the gate voltage of the P-type MOS transistor MP9 and the gate voltage of the P-type MOS transistor MP13 are all pulled down. Further, the operational amplifier unit 301 operates at the first stable operating point to exit the operating point at which Vout=0 (i.e., the second stable operating point). When the gate voltage of the P-type MOS transistor MP13 is pulled down, the P-type MOS transistor MP13 is conducted to allow the current to pass through, the N-type MOS transistor MN11 is an extremely large resistor, and the gate voltage of the P-type MOS transistor MP14 and the gate voltage of the P-type MOS transistor MP15 are increased, such that the P-type MOS transistor MP14 and the P-type MOS transistor MP15 are turned off. At this point, the operational amplifier unit 301 operates at the third stable operating point. With the output end 305 of the operational amplifier unit 301 in conjunction with the voltage source, the voltage range of the voltage source is between −0.5V and 3.2V. FIG. 6 shows a relationship diagram of the current passing through the voltage source and the voltage of the voltage source. As shown in FIG. 6, an operating point A1 is the third stable operating point, an operating point B1 is the first stable operating point, and an operating point C1 is an unstable operating point.

Figure 7:
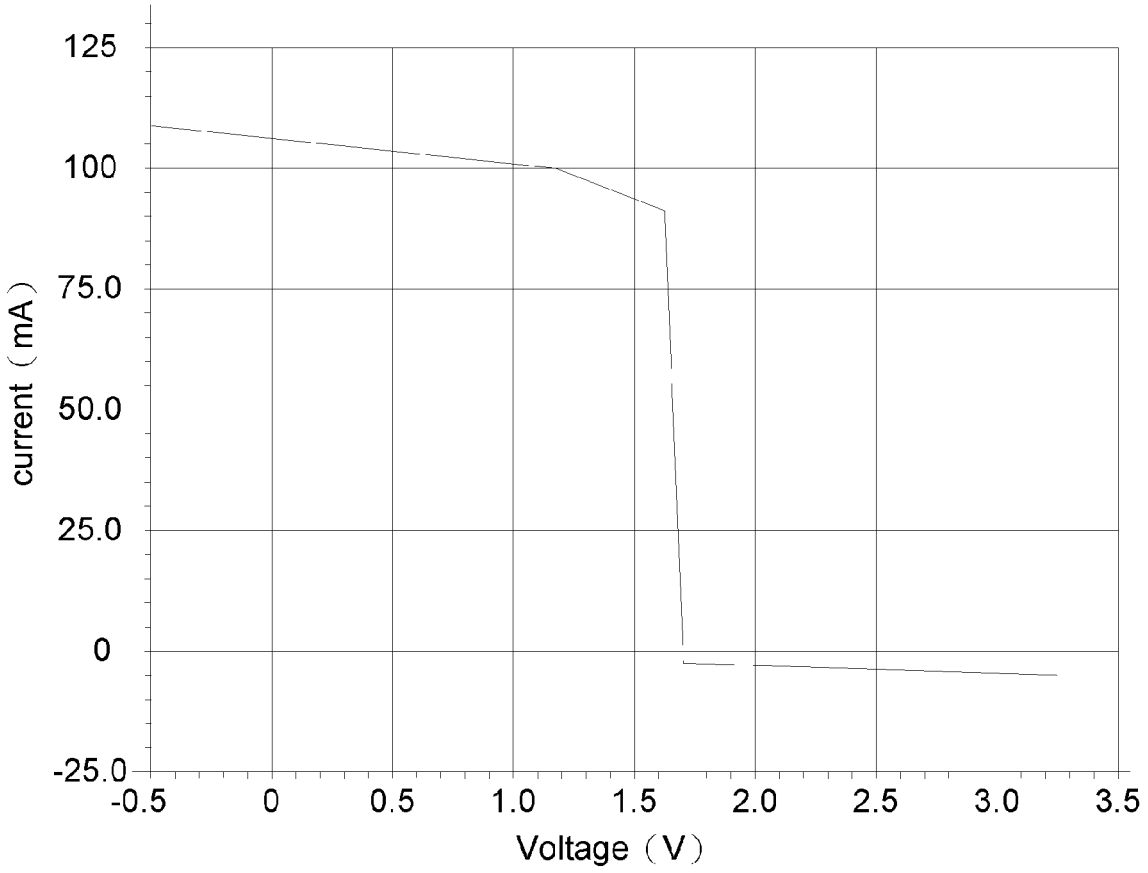
FIG. 7 is a relationship diagram of a current passing through a voltage source and a voltage of the voltage source after coupling the operational amplifier unit in FIG. 3 to a second auto-activation unit.

In the embodiment, the operational amplifier unit 301 is further coupled to the second auto-activation unit 307. The source of the P-type MOS transistor MP16, the source of the P-type MOS transistor MP17, and the source of the P-type MOS transistor MP18 are connected to the first reference voltage VDD. The gate of the P-type MOS transistor MP16 is grounded. The gate of the P-type MOS transistor MP16 is connected to the drain of the N-type MOS transistor MN14. The drain of the N-type MOS transistor MN14 is further connected to the gate of the N-type MOS transistor MN14 and the gate of the N-type MOS transistor MN15. The source of the N-type MOS transistor MN14 is grounded. The gate of the P-type MOS transistor MP17 is connected to the gate of the P-type MOS transistor MP18. The drain of the P-type MOS transistor MP17 is connected to the drain of the N-type MOS transistor MN15 and the gate of the P-type MOS transistor MP17. The drain of the P-type MOS transistor MP18 is connected between the second resistor R4 and the third resistor R5. The source of the N-type MOS transistor MN15 is connected to the source of the N-type MOS transistor MN1. At this point, with the operational amplifier unit 301 in conjunction with the second auto-activation unit 307, instead of also being operable the third stable operating point, the operational amplifier unit 301 only operates at the first stable operating point. Operation principles of such as described as follows. The N-type MOS transistor MN15 is biased by the N-type MOS transistor MN14 and the P-type MOS transistor MP16. When the source voltage of the N-type MOS transistor MN15 is low, the N-type MOS transistor MN15 is conducted. A current is mirrored to the first resistor R3, the second resistor R4, and the third resistor R5 via the P-type MOS transistor MP17 and the P-type MOS transistor MP18, so as to pull up the voltage at the output end 305 of the operational amplifier unit 301 and the gate voltage of the N-type MOS transistor MN1 to further draw the operational amplifier unit 301 away from the third operating point. At this point, the current passing through the N-type MOS transistor MN1 and the N-type MOS transistor MN2 increases while the gate voltage of the P-type MOS transistor MP9 reduces, and the output current at the output end 305 of the operational amplifier unit 301 is increased to increase the reference voltage Vref output by the operational amplifier unit 301. As such, a greater amount of current passes through the N-type MOS transistor MN1 and the N-type MOS transistor MN2 to form a positive feedback. When the operational amplifier unit 301 operates at the first stable operating point, the source voltage of the N-type MOS transistor MN15 reaches 1V, the N-type MOS transistor MN15 is turned off, and the second auto-activation unit 307 stops operating. FIG. 7 shows a relationship diagram of the current passing through the voltage source and the voltage of the voltage source. As shown in FIG. 7, with the output end 305 of the operational amplifier unit 301 in conjunction with the voltage source, the operational amplifier unit 301 operates at only the first stable operating point, i.e., the normal operating point.

Figure 8:
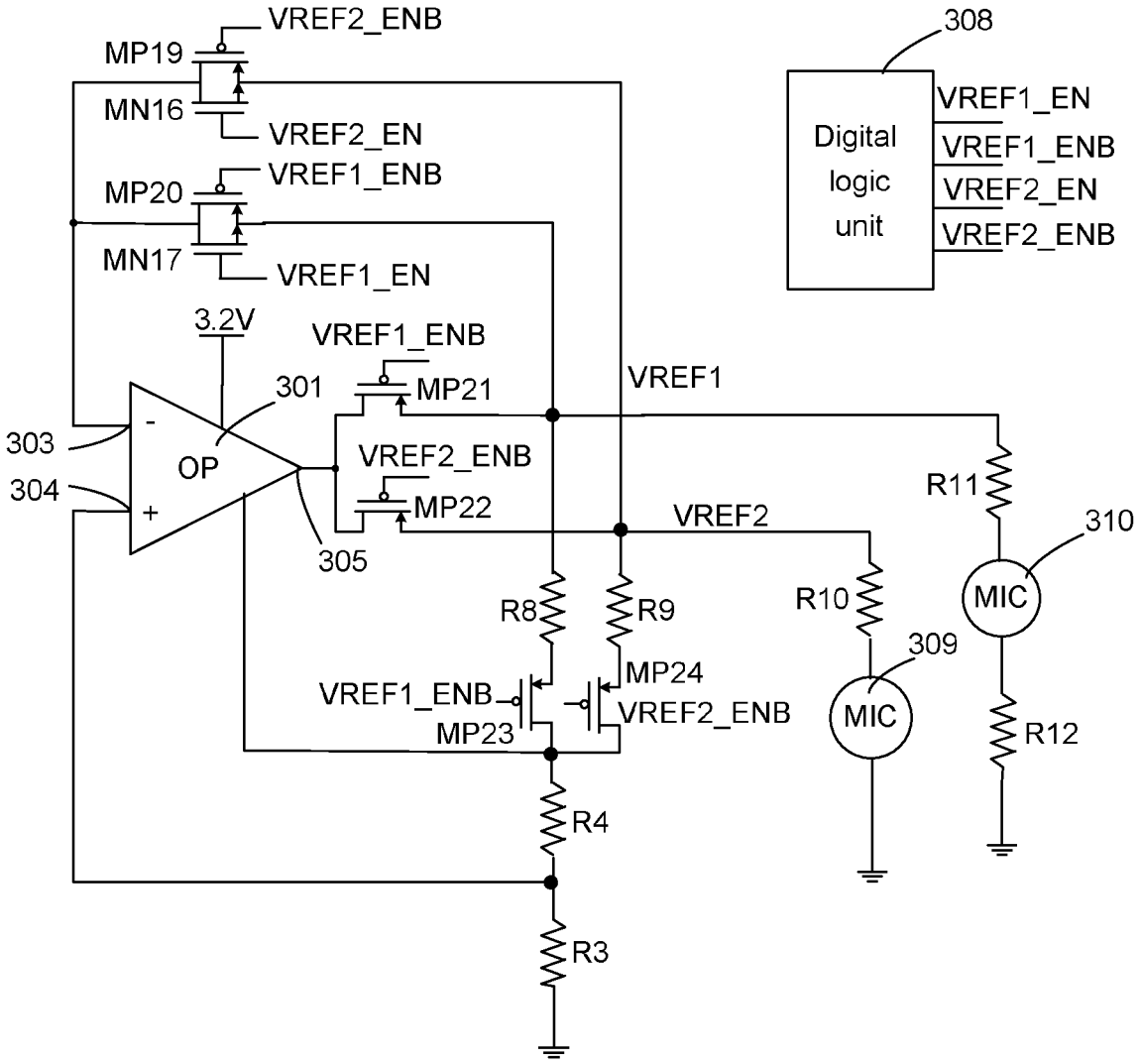
FIG. 8 is a schematic diagram of the reference voltage generation circuit in FIG. 3 applied to a microphone bias circuit.

FIG. 8 shows a schematic diagram of the reference voltage generation in FIG. 3 applied to a MICBIAS. As shown in FIG. 8, the inverting input end 303 of the operational amplifier unit 301 serves as an inverting input end of the reference voltage generation circuit 30, the non-inverting input end 304 of the operational amplifier unit 301 serves as a non-inverting input end of the reference voltage generation circuit 30, and the output end 305 of the operational amplifier unit 301 serves as an output end of the reference voltage generation circuit 30.

The inverting input end 303 of the operational amplifier unit 301 is connected to the drain of a P-type MOS transistor MP19, the drain of a P-type MOS transistor MP20, the drain of the N-type MOS transistor MN1, and the drain of the N-type MOS transistor MN17. The gate of the P-type MOS transistor MP19 is connected to VREF2_ENB of a digital logic unit 308. The gate of the P-type MOS transistor MP20 is connected to VREF1_ENB of the digital logic unit 308. The gate of the N-type MOS transistor MN16 is connected to VREF2_EN of the digital logic unit 308. The gate of the N-type MOS transistor MN17 is connected to VREF1_EN of the digital logic unit 308. The output end 305 of the operational amplifier unit 301 is connected to the drain of a P-type MOS transistor MP21 and the drain of a P-type MOS transistor MP22. The gate of the P-type MOS transistor MP21 is connected to VREF1_ENB of the digital logic circuit 308. The gate of the P-type MOS transistor MP22 is connected to VREF2_ENB of the digital logic circuit 308. The source of the P-type MOS transistor MP19 and the source of the N-type MOS transistor MN16 are both connected to the source of the P-type MOS transistor MP22. The source of the P-type MOS transistor MP20 and the source of the N-type MOS transistor MN17 are both connected to the source of the P-type MOS transistor MP21. The non-inverting input end 304 of the operational amplifier unit 301 is connected between the first resistor R3 and the second resistor R4. The other end of the second resistor R4 is connected to the drain of a P-type MOS transistor MP23, the drain of a P-type MOS transistor MP24, and the drain of the P-type MOS transistor MP18. The gate of the P-type MOS transistor MP23 is connected to VREF1_ENB of the digital logic unit 308. The source of the P-type MOS transistor MP23 is connected to one end of a resistor R8, which has the other end connected to the source of the P-type MOS transistor MP21. The gate of the P-type MOS transistor MP24 is connected to VREF2_ENB of the digital logic unit 308. The source of the P-type MOS transistor MP24 is connected to one end of a resistor R9, which has the other end connected to the source of the P-type MOS transistor MP22. The source of the P-type MOS transistor MP21 is connected to one end of a resistor R11, which has the other end connected to a positive end of a microphone 310. A negative end of the microphone 310 is grounded via a resistor R12. The source of the P-type MOS transistor MP22 is further connected to one end of a resistor R10, which has the other end connected to a positive end of a microphone 309. The negative end of the microphone 309 is grounded. The voltage value of the first reference voltage VDD is 3.2V.

Operation principles of the MICBIAS are described in detail below.

When VREF1_ENB of the digital logic unit 308 outputs a signal, the P-type MOS transistor MP20, the P-type MOS transistor MP21, and the P-type MOS transistor MP23 are controlled to be conducted. At this point, the output end 305 of the operational amplifier unit 301 outputs a reference voltage VREF1 to the microphone 310 for operating the microphone 310.

When VREF2_ENB of the digital logic unit 308 outputs a signal, the P-type MOS transistor MP19, the P-type MOS transistor MP22, and the P-type MOS transistor MP24 are controlled to be conducted. At this point, the output end 305 of the operational amplifier unit 301 outputs a reference voltage VREF2 to the microphone 309 for operating the microphone 309.

Different from the prior art, the circuit 30 disclosed by the embodiments realizes a tail current by implementing a tail current resistor R7 without involving an additional voltage source or a large-size capacitor, thereby reducing noises as well as an area and costs of the circuit 30. Further, by adopting the auto-activation unit 302 in the circuit 30 disclosed by the embodiments, the circuit 30 is allowed to output a stable reference voltage at a normal operating point.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A reference voltage generation circuit, comprising:

an auto-activation unit;

an operational amplifier unit; and a tail current resistor;

wherein, an input end of the operational amplifier unit is grounded via the tail current resistor, and the auto-activation unit is coupled to the operational amplifier unit so that the reference voltage generation circuit operates at an operating point.

2. The reference voltage generation circuit according to claim 1, further comprising:

a first resistor, a second resistor, and a third resistor;

wherein, the first resistor has one end connected to a non-inverting input end of the operational amplifier unit and one other end grounded, the second resistor has one end connected to the non-inverting input end of the operational amplifier unit, and the second resistor and the third resistor are connected in series between the non-inverting input end of the operational amplifier unit and an input end of the operational amplifier unit to form a positive feedback loop; and an inverting input end of the operational amplifier unit is connected to the output end of the operational amplifier unit to form a negative feedback loop.

3. The reference voltage generation circuit according to claim 2, wherein the operational amplifier unit comprises a first-stage mirror compensation unit and a second-stage mirror compensation unit; the first-stage mirror compensation unit and the second-stage mirror compensation unit are connected in parallel between the non-inverting input end of the operational amplifier unit, the inverting input end of the operational amplifier unit and the output end of the operational amplifier unit.

4. The reference voltage generation circuit according to claim 3, wherein the auto-activation unit comprises a first auto-activation unit and a second auto-activation unit, and the first auto-activation unit and the second auto-activation unit are connected in parallel with the operational amplifier unit, respectively.

5. The reference voltage generation circuit according to claim 4, wherein the first auto-activation unit comprises a first MOS transistor, a second MOS transistor, a third MOS transistor, and a fourth MOS transistor;

wherein a source of the first MOS transistor, a gate of the second MOS transistor, a source of the third MOS transistor, and a source of the fourth MOS transistor are connected to a first reference voltage;

wherein a gate of the third MOS transistor, a gate of the fourth MOS transistor and a drain of the second MOS transistor are connected to a drain of the first MOS transistor;

wherein a source of the second MOS transistor is grounded;

wherein a gate of the first MOS transistor, a drain of the third MOS transistor, and a drain of the fourth MOS transistor are connected to the operational amplifier unit.

6. The reference voltage generation circuit according to claim 5, wherein the second auto-activation unit comprises a fifth MOS transistor, a sixth MOS transistor, a seventh MOS transistor, an eighth MOS transistor, and a ninth MOS transistor;

wherein a source of the fifth MOS transistor, a source of the sixth MOS transistor and a source of the seventh MOS transistor are connected to the first reference voltage;

wherein a gate of the fifth MOS transistor and a gate of the sixth MOS transistor are connected to a drain of the sixth MOS transistor;

wherein a drain of the ninth MOS transistor is connected to the drain of the sixth MOS transistor;

wherein a gate of the seventh MOS transistor is grounded;

wherein a drain of the seventh MOS transistor, a drain of the eighth MOS transistor, a gate of the eighth MOS transistor, and a gate of the ninth MOS transistor are connected;

wherein a source of the eighth MOS transistor is grounded;

wherein the drain of the fifth MOS transistor and the gate of the ninth MOS transistor are connected to the operational amplifier unit.

7. The reference voltage generation circuit according to claim 6, wherein the first MOS transistor, the third MOS transistor, the fourth MOS transistor, the fifth MOS transistor, the sixth MOS transistor, and the seventh MOS transistor are all P-type MOS transistors;

wherein the second MOS transistor, the eighth MOS transistor and the ninth MOS transistor are all N-type MOS transistors.

8. The reference voltage generation circuit according to claim 1, wherein the operational amplifier unit comprises three stable operating points;

wherein a first stable operating point is a normal operating point, a second stable operating point is when an output voltage of the operational amplifier unit is zero, a third stable operating point is when the output voltage of the operational amplifier unit is lower than the output voltage of the first stable operating point;

wherein the auto-activation unit is coupled to the operational amplifier unit so that the reference voltage generation circuit operates at the first stable operating point.

9. The reference voltage generation circuit according to claim 1, wherein the reference voltage generation circuit is connected to a microphone bias circuit to provide the microphone bias circuit with a voltage; the microphone bias circuit comprises a digital logic unit, a plurality of MOS transistors and a microphone; the microphone is connected to the MOS transistors and the operational amplifier unit; the digital logic circuit is connected to a plurality of gates of the MOS transistors to control the MOS transistors to be disconnected or conducted.

* * * * *